United States Patent [19]

Ficken

[11] Patent Number: 4,823,984

[45] Date of Patent: Apr. 25, 1989

[54] CONTAINER STORAGE AND DISPENSING APPARATUS AND VENDING MACHINE FOR DISPENSING REFRIGERATED, UNREFRIGERATED AND/OR HEATED FOODS

[75] Inventor: Leonard A. Ficken, St. Louis County, Mo.

[73] Assignee: Unidynamics Corporation, New York, N.Y.

[21] Appl. No.: 41,760

[22] Filed: Apr. 21, 1987

Related U.S. Application Data

[63] Continuation-in-part of Ser. No. 857,937, Apr. 30, 1986, Pat. No. 4,730,750.

[51] Int. Cl.[4] ..... A47F 1/00

[52] U.S. Cl. ..... 221/96; 221/97; 221/126; 221/150 HC; 221/195; 221/155

[58] Field of Search ..... 221/96, 97, 123, 124, 221/126, 129, 130, 131, 133, 150 HC, 150 R, 150 A, 191, 194, 195, 155, 258, 287, 289; 312/36, 42

[56] References Cited

U.S. PATENT DOCUMENTS

| | | | |
|---|---|---|---|
| Re. 31,162 | 3/1983 | Bachmann et al. | 221/131 X |
| 1,734,045 | 11/1929 | Parran | 194/300 X |
| 2,325,363 | 7/1943 | Blake | 221/130 |
| 2,682,984 | 7/1954 | Melikian et al. | 221/96 |
| 2,726,026 | 12/1955 | Gould et al. | 221/96 X |
| 2,834,510 | 5/1958 | Cenotti | 221/79 |
| 2,956,660 | 10/1960 | Nordquist | 221/281 X |
| 2,963,883 | 12/1960 | Teesdale | 221/124 |
| 3,160,255 | 12/1964 | Ferraro et al. | 221/150 HC |
| 3,178,055 | 4/1965 | Schuller | 221/129 X |
| 3,393,830 | 7/1968 | Phillips et al. | 221/129 X |
| 3,722,745 | 3/1973 | Gushi et al. | 221/130 |
| 3,737,071 | 6/1973 | Offutt et al. | 221/129 |
| 3,795,345 | 3/1974 | Baxendale | 221/125 |
| 3,986,759 | 10/1976 | Holstein et al. | 312/257 A |
| 4,248,358 | 2/1981 | Muench | 221/150 A |
| 4,368,829 | 1/1983 | Lotspeich et al. | 221/129 X |
| 4,426,017 | 1/1984 | Ficken et al. | 221/222 |
| 4,485,937 | 12/1984 | Adams | 221/129 |
| 4,512,453 | 4/1985 | Schuller et al. | 194/200 |
| 4,629,090 | 12/1986 | Harris et al. | 221/150 R X |

FOREIGN PATENT DOCUMENTS

| | | | |
|---|---|---|---|
| 241935 | 12/1962 | Australia | 221/150 R |
| 896831 | 5/1962 | United Kingdom | 221/150 HC |

*Primary Examiner*—Kevin P. Shaver
*Assistant Examiner*—David H. Bollinger
*Attorney, Agent, or Firm*—Senniger, Powers, Leavitt and Roedel

[57] ABSTRACT

A container storage and dispensing apparatus. The apparatus includes a housing for enclosing a storage and dispensing area, the housing having an access door for inserting the containers and having a first and a second exit door for dispensing the containers. The apparatus also includes first and second guides for guiding and supporting containers to the first exit door. Further the apparatus includes third and fourth guides for guiding and supporting containers to the second exit door. Additionally, the apparatus includes first and second dispensers for selectably dispensing one of the containers, each dispenser including a levered gate movable between an open and a closed position, the levered gate when in the closed position for retaining the container in the storage and dispensing area and when in the open position for dispensing one of the containers through the exit door and for retaining the remaining containers in the storage and dispensing area and an apparatus for moving the levered gate from the closed position to the open position to dispense one of the containers and to return the gate to the closed position. Also disclosed is a vending machine for dispensing refrigerated, unrefrigerated and/or heated foods.

67 Claims, 11 Drawing Sheets

CONTAINER STORAGE AND DISPENSING APPARATUS AND VENDING MACHINE FOR DISPENSING REFRIGERATED, UNREFRIGERATED AND/OR HEATED FOODS

BACKGROUND OF THE INVENTION

This is a continuation-in-part of application Ser. No. 857,737, filed Apr. 30, 1986 U.S. Pat. No. 4,730,750, issued Mar. 15, 1984. This invention relates to a container storage and dispensing apparatus and a vending machine for dispensing refrigerated foods, for example drink containers, unrefrigerated foods such as packaged snacks and/or heated foods such as hot coffee.

It is generally known that vending machines can provide a refrigerated section to keep products cold. For example, food vending machines are known for dispensing sandwiches or cold drinks by inserting coins or bills. It is also generally known to provide vending machines which dispense products which are not refrigerated. For example, candy or snack food packages are generally kept in a non-refrigerated vending machine. Vending machines are also available for dispensing heated foods, for example, coffee and cocoa machines dispense heated liquids. Very often it is desired to have both unrefrigerated, refrigerated and heated foods dispensed at the same physical location, such as in an employee kitchen. However it is impractical due to space limitations to use a refrigerated vending machine, an unrefrigerated vending machine and a heated vending machine. Some presently available vending machines have refrigerated and unrefrigerated sections or areas, but require all the dispensed products to pass through both the refrigerated and unrefrigerated sections prior to dispensing. In these vending machines it is not possible to independently or separately dispense the product from the refrigerated and unrefrigerated sections. Nor do these vending machines provide for the dispensing of heated product.

Very often the use of the non-refrigerated vending machine results in the candy or the like being destroyed because of melting, thus resulting in customer dissatisfaction or loss of the product. Because many unrefrigerated foods are most palatable at a temperature most near room temperature, it is generally not desirable to refrigerate this product down to a temperature for which refrigerated foods are enjoyed. Therefore it is undesirable, for example, to place candy or the like in a refrigerated machine since these machines typically cool to around 35°–45° F. It is also desirable that existing unrefrigerated machines be easily converted to have a refrigerated area.

SUMMARY OF THE INVENTION

Among the several objects of the invention may be noted the provision of a vending machine permitting the dispensing of refrigerated product and heated product from a single machine; the provision of such a vending machine which will also dispense unrefrigerated product; the provision of such vending machine which is suitable for locations having space limitations; the provision of such vending machine which permits the independent and separate dispensing of refrigerated, unrefrigerated and heated product; the provision of such vending machine which partially cools product in the unrefrigerated section of the vending machine; the provision of such vending machine which has a single selection control for choosing refrigerated, unrefrigerated and/or heated product; the provision of such vending machine which is economically feasible and commercially practical; the provision of an apparatus for storing and dispensing drink containers; the provision of such apparatus to which cooling may be added to provide a refrigerated area; the provision of such apparatus which is suitable for use in existing unrefrigerated vending machines; and the provision of such apparatus which is compact.

Briefly described, a container storage and dispensing apparatus of the present invention includes housing means for enclosing a storage and dispensing area, the housing means having an access door for inserting the containers and having a first and a second exit door for dispensing the containers. The apparatus includes first guide means in the housing means for guiding and supporting a first level of containers away from the access door toward a first intermediate location near the rear of the housing means and second guide means in the housing means for receiving containers from the first guide means at the first intermediate location, for guiding and supporting a second level of containers away from the intermediate location to the first exit door. The apparatus further includes third guide means in the housing means for guiding and supporting a third level of containers away from the access door toward a second intermediate location near the rear of the housing means, the third level of containers being positioned below the first level and the second intermediate location being closer the access door than the first intermediate location and fourth guide means in the housing means for receiving containers from the third guide means at the second intermediate location and for guiding and supporting a fourth level of containers away from the intermediate location to the second exit door, the fourth level of containers being positioned above the second level. Additionally, the apparatus includes first and second means respectively associated with the second and fourth levels for selectably dispensing one of the containers from either the second or fourth levels. Each dispensing means includes a levered gate movable between an open and a closed position, the levered gate when in the closed position for retaining the container in the storage and dispensing area and when in the open position for dispensing one of the containers through the exit door and for retaining the remaining containers in the storage and dispensing area. The dispensing means also includes means for moving the levered gate from the closed position to the open position to dispense one of the containers and to return the gate to the closed position.

Briefly described, a vending machine of the present invention is for dispensing refrigerated and heated foods. The vending machine includes a housing having a refrigerated storage and dispensing area for the refrigerated foods and a heated storage and dispensing area for the heated foods, each area being separate from the other area. The vending machine also includes a device contained in the housing for cooling the refrigerated foods in the refrigerated storage and dispensing area. The vending machine further includes a device contained in the housing for heating the heated foods in the heated storage and dispensing area. Additionally, the vending machine has a first receiving device adjacent the refrigerated storage and dispensing area for receiving dispensed foods from the refrigerated storage and dispensing area and a second receiving device for receiving the heated food from the heated storage and dispensing area. The vending machine also has a common device for selecting one of the refrigerated foods or heated foods to be dispensed to the first or second receiving device, respectively and a device responsive to the selecting means for dispensing the selected food to the first or second receiving device.

Briefly described, another form of the vending machine of the present invention is for dispensing refrigerated, unrefrigerated and heated foods. The vending machine includes a housing having a refrigerated storage and dispensing area for the refrigerated foods, an unrefrigerated storage and dispensing area for the unrefrigerated foods and a heated storage and dispensing area for the heated foods, each area being separate from the other areas. The vending machine also includes a device contained in the housing means for cooling the refrigerated foods in the refrigerated storage and dispensing area and a device contained in the housing means for heating the heated foods in the heated storage and dispensing area. The vending machine further includes a common receiving device adjacent the refrigerated and unrefrigerated storage and dispensing areas for receiving dispensed foods from either the refrigerated or unrefrigerated storage and dispensing area and a separate device for receiving the heated food from the heated storage and dispensing area. Additionally, the vending machine includes a common device for selecting one of the refrigerated foods, unrefrigerated foods or heated foods to be dispensed to the common receiving device or separate receiving device and a device responsive to the selecting device for dispensing the selected food to the common receiving device or separate receiving device.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
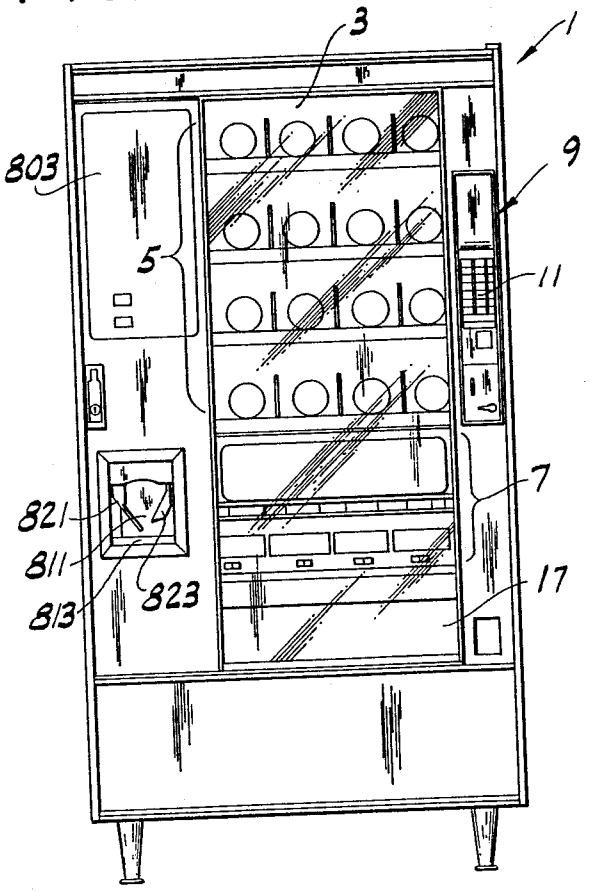
FIG. 1 is a front view of the vending machine of the present invention.

In FIG. 1 the vending machine 1 of the present invention has a door 3 having a clear see-thru panel for displaying foods in the vending machine. Unrefrigerated foods, such as candy or food packages, are displayed in the vending machine 1 in an upper section or unrefrigerated food storage and dispensing area 5. Analogously, refrigerated foods, such as drink containers or cans, are displayed in a lower section or refrigerated food storage and dispensing area 7. Additionally, machine 1 includes a display 803 which shows pictures of heated foods stored in a heated storage and dispensing area 805. Area 805 is separated from the areas 5 and 7 by a divider 807.

A selection panel 9 has a plurality of push button switches 11 corresponding to a respective product in dispensers of the unrefrigerated, refrigerated or heated storage and dispensing areas 5, 7 and 805. The selection panel 9 includes a vendor control and selection system as described in U.S. Pat. No. 4,512,453, which is incorporated herein by reference. Money is inserted in the selection panel 9 and when a proper amount is inserted, push button switches 11 may be operated. In response to a pushed switch 11, refrigerated or unrefrigerated foods are dispensed to a common receiving device or curved shelf 18 which is accessible through an opening 17 in the door 3. Heated foods may also be dispensed in response to a pushed switch 11 to a separate receiving device 811 accessible through an opening 813 in the door 3.

Figure 2:
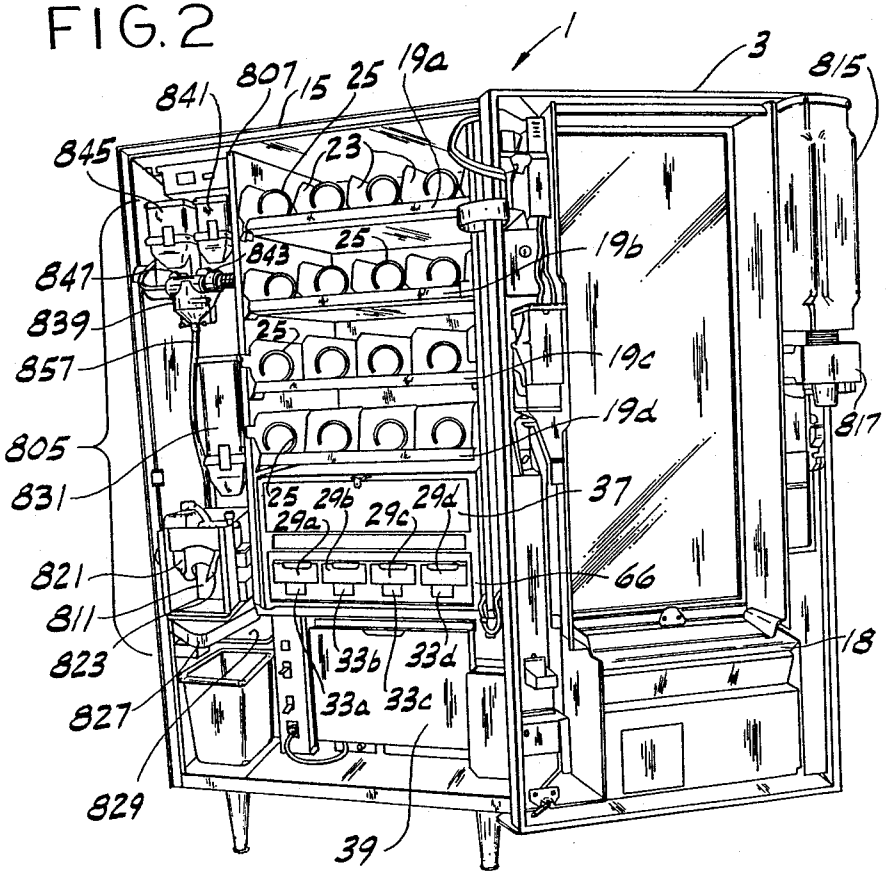
FIG. 2 is a perspective view of the vending machine of FIG. 1 with a front door opened.
Figure 3:
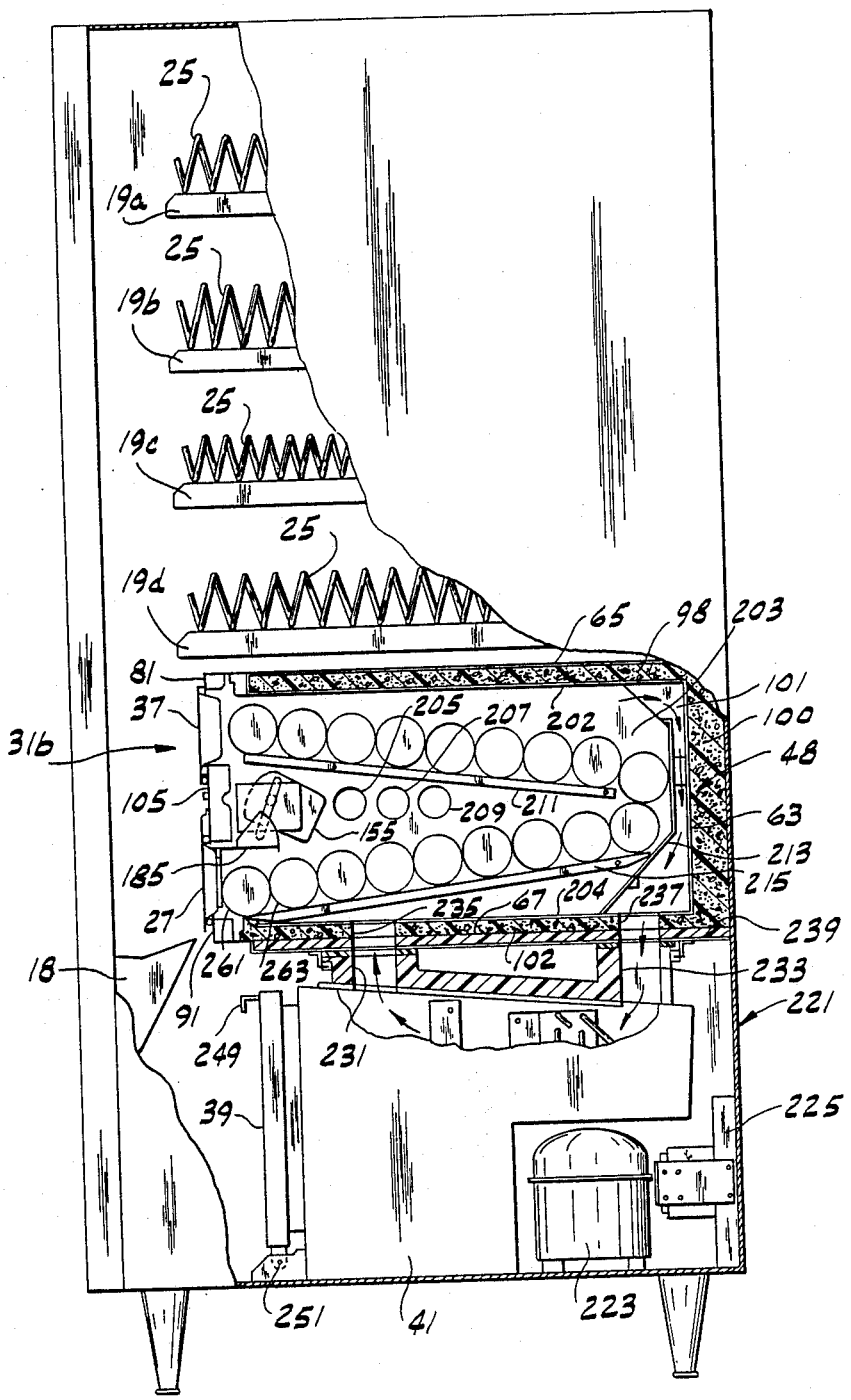
FIG. 3 is a side view of the vending machine in FIG. 1 with a portion cutaway showing an interior cross-section including a refreigerated and unrefrigerated area.
Figure 4:
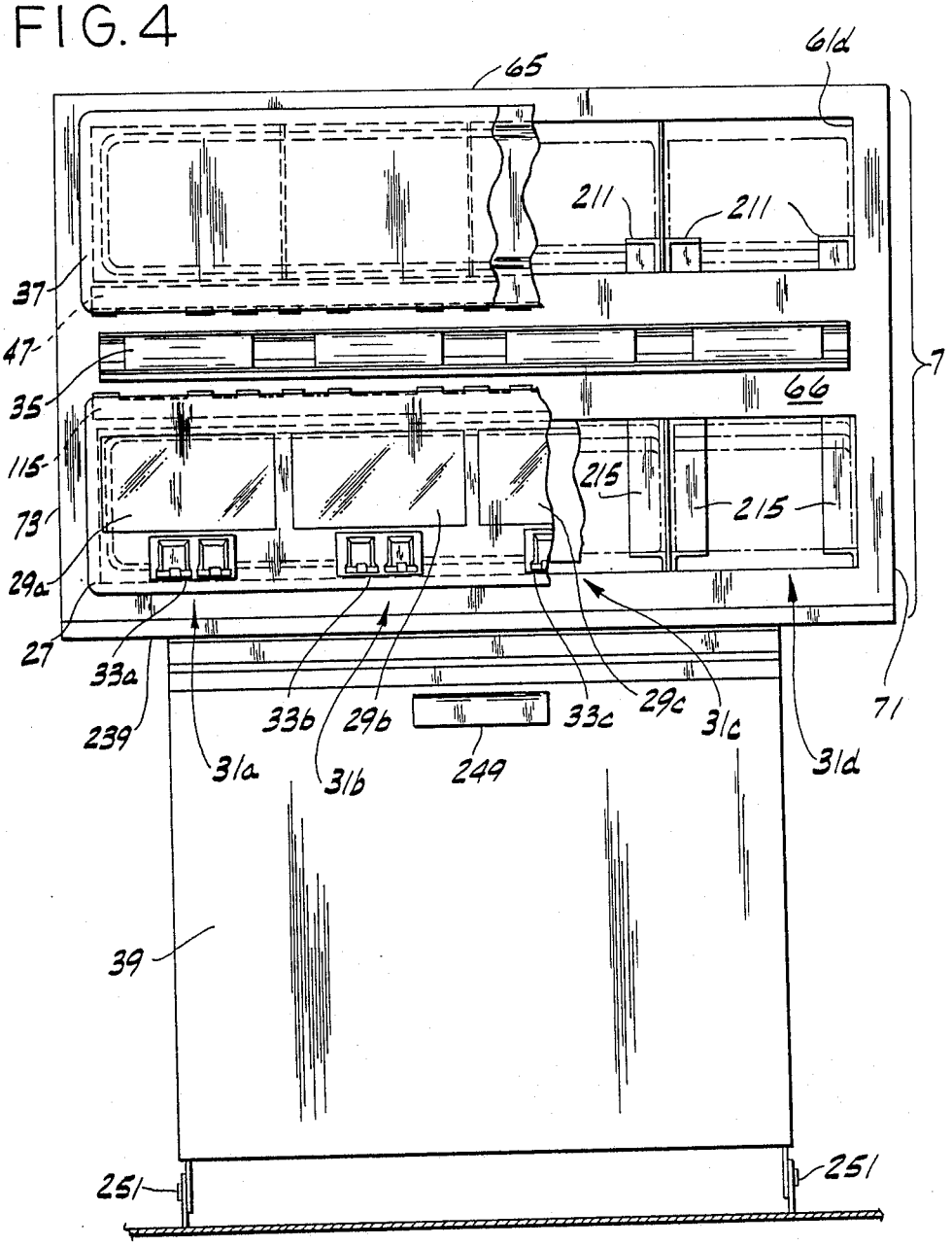
FIG. 4 is a close up view of a refrigerated area of the vending machine in FIG. 1 with a portion cutaway.

As may best be seen in FIGS. 2, 3 and 4, the door 3 is mounted on an exterior housing 15 and may be opened for access to the vending machine interior which includes the unrefrigerated and refrigerated storage and dispensing areas 5 and 7 and the heated storage and dispensing area 805. The housing 15 thus constitutes housing means having a refrigerated storage and dispensing area for the refrigerated foods, an unrefrigerated storage and dispensing area for the unrefrigerated foods and a heated storage and dispensing area for the heated foods, each area being separate from the other area.

The unrefrigerated storage and dispensing area 5 has four shelves **19*a*, 19*b*, 19*c* and 19*d*. Each of the shelves 19 has separators 23 between spiral arms 25 in which the unrefrigerated foods such as candy bars or snack food packages are placed. The spiral arms 25 are rotated by motors (not shown) in response to a machine controller as shown in FIG. 1** of U.S. Pat. No. 4,512,453 for dispensing the unrefrigerated foods. A dispenser having spiral arms for dispensing food packages is shown in U.S. Pat. No. 3,986,759, which is incorporated herein by reference.

The refrigerated storage and dispensing area 7 has a clear continuous exit door 27 masked so that four windows **29*a*, 29*b*, 29*c* and 29*d* are outlined for displaying the drink can to be next dispensed from one of four corresponding dispensers 31*a*, 31*b*, 31*c* and 31*d*. For illustration purposes the dispenser 31*b* is shown in FIG. 3. As will be appreciated from the discussion there are four dispensers 31. Labels 33*a*, 33*b*, 33*c* and 33*d* may be mounted below the corresponding window 29 for displaying such things as price and item number for the corresponding switch on the selection panel 9. Additional track labelling 35 may also be attached above the windows 29 to further identify the refrigerated foods, e.g., brand names. A door 37 is mounted above the labelling 35 and may also have labels attached thereto. Another door 39 is mounted below the windows 29 and provides access to a refrigerated storage area 41**.

Figure 5:
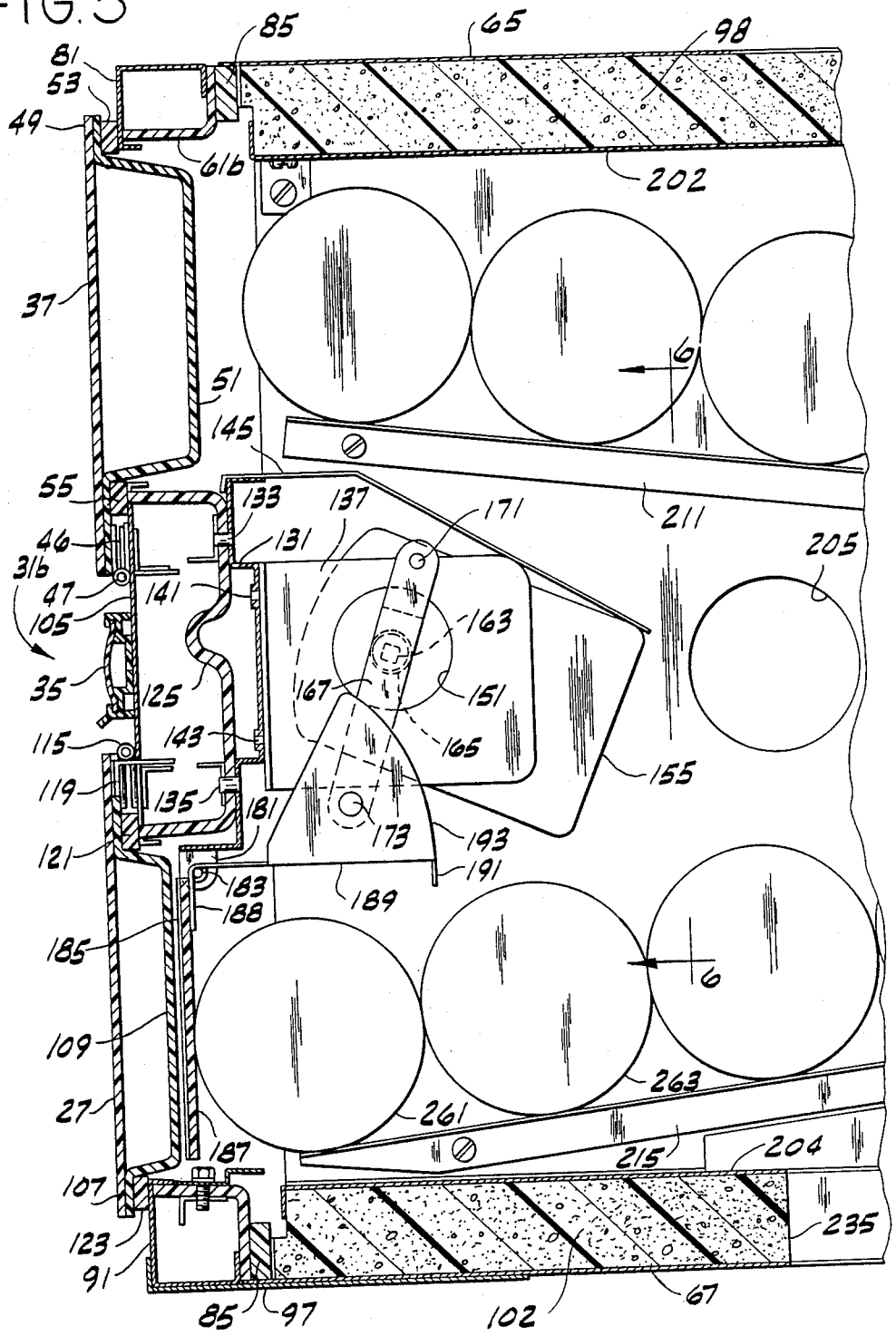
FIG. 5 is a side view of a drink can dispenser of the vending machine in FIG. 1.

As may best be seen in FIGS. 3, 4 and 5, the door 37 is attached to a generally rectangularly shaped housing 48 for enclosing the storage and dispensing area 7. The door 37 is mounted on a strip hinge 47 with spring 46 which tends to keep the door 37 in a vertical or closed position. The spring 46 is an example of spring means tending to keep the door closed. Door 37 consists of two pieces of material, an outside piece 49 and an inside piece 51 with an air insulating space therebetween. The door 37 tends to be pressed against gaskets 53 and 55 by the spring 46 to seal the storage and dispensing area 7. Each of the dispensers 31 has a corresponding opening 61 in the housing 48 behind the door 37. For example, as shown in FIG. 5, dispenser **31*b* has an opening 61*b* for the insertion of the drink cans into the dispenser 31*b***.

The housing 48 includes rear panel 63, top panel 65 and bottom panel 67. The top panel 65 and bottom panel 67 are secured to side panels 71 and 73 and rear panel 63. The housing 48 also includes a front frame 66 which incorporates a top cross member 81, a bottom cross member 91 and a center cross member 105. A sealing gasket 85 seals between the front frame 66 and the top panel 65, bottom panel 67 and side panels 71 and 73. Additional support is provided by overlapping corner piece 97. Pieces of insulating material 98 and 100 are used for insulation around the housing 48.

The center cross member 105 which extends from side panel 71 to side panel 73 has the strip hinge 47 for door 37 mounted thereto and the labelling 35 is also attached to the cross member 105. The clear door 27 is constructed similarly to door 37 and includes outside piece 107 and inside piece 109 with an air space therebetween for insulation. A strip hinge 115 is attached to the center cross member 105 and door 27 to permit the door to swing outward. A spring 119 tends to press the door 27 toward door gaskets 121 and 123 to seal the storage and dispensing area 7. Center cross member 105 includes a C-shaped portion 125 to which is attached channel or mounting bracket 131 by rivets 133 and 135.

Figure 5A:
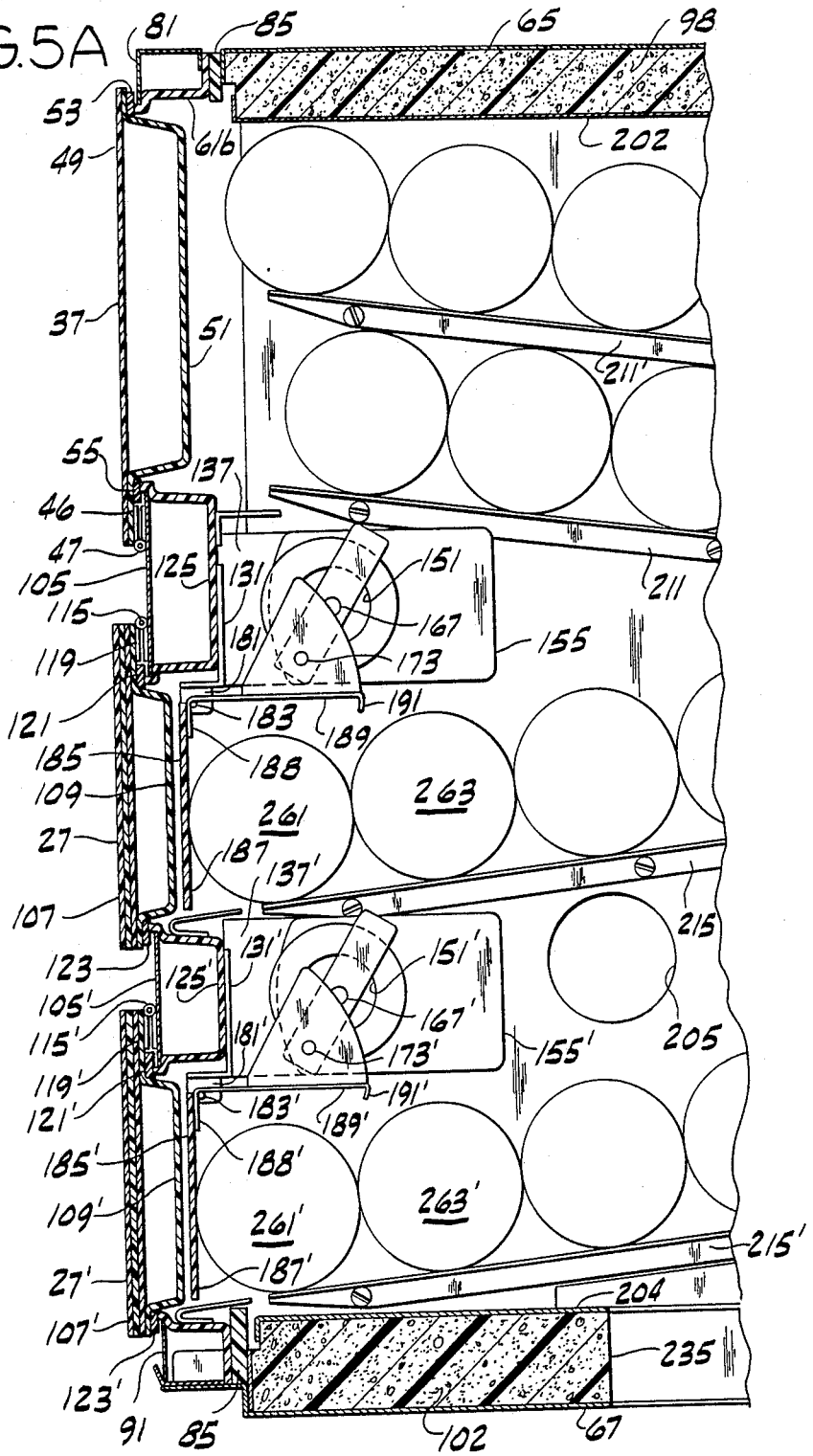
FIG. 5A is a side view of a drink can dispenser of the vending machine in FIG. 3A.
Figure 5B:
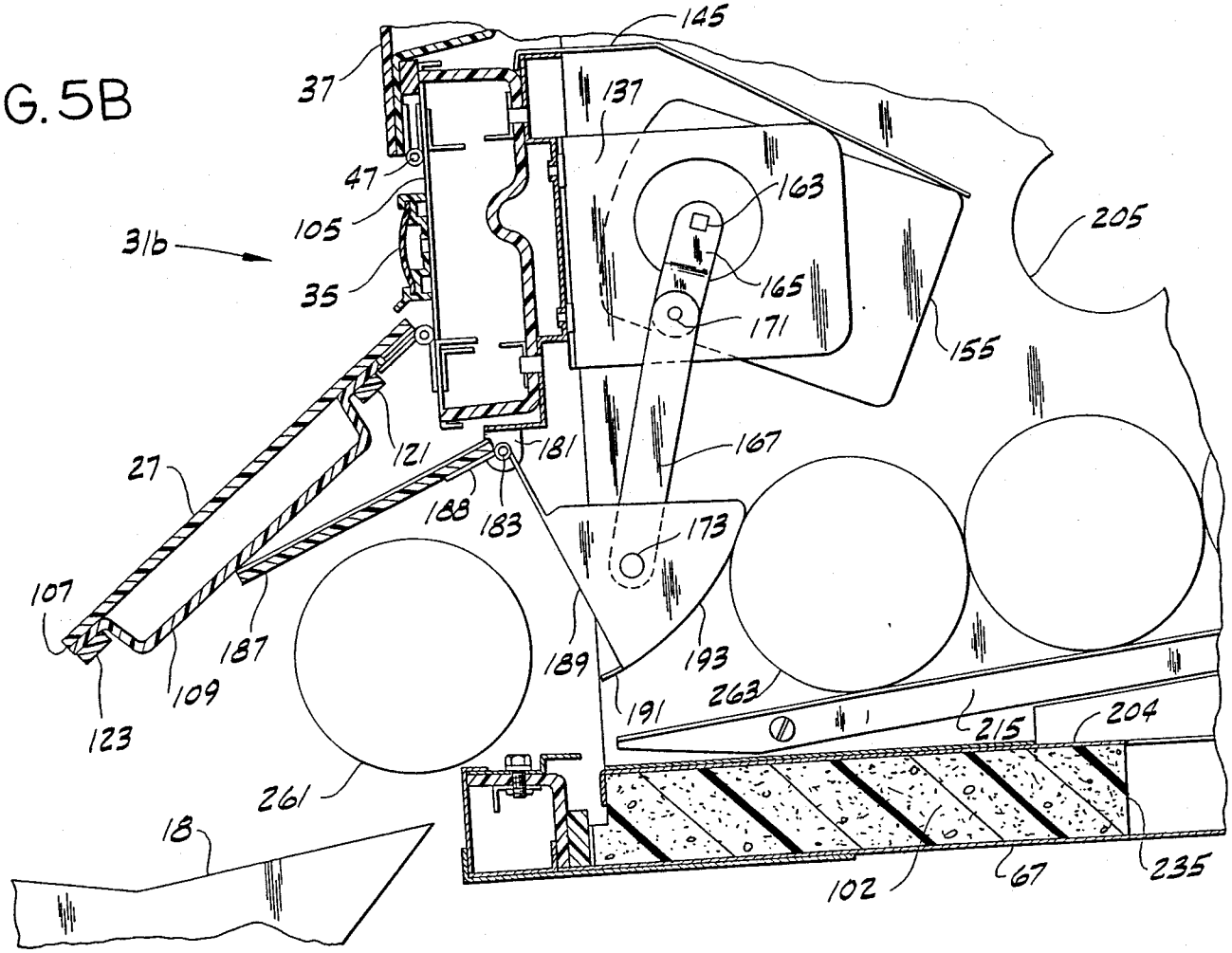
FIG. 5B is a side view of the drink can dispenser in FIG. 5 showing a can being dispensed.
Figure 6:
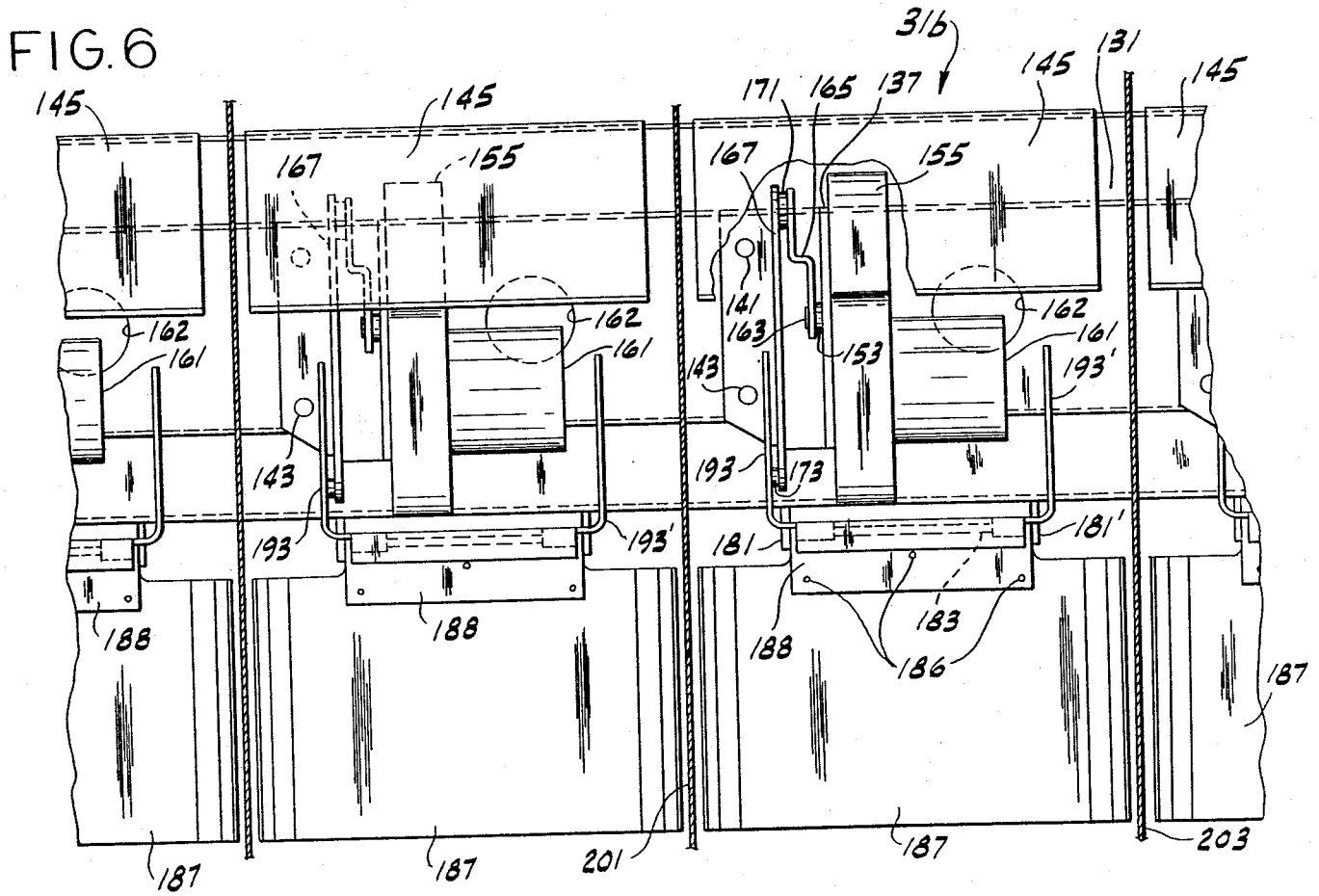
FIG. 6 is a view from the line 6—6 in FIG. 5.

For illustration purposes the dispenser **31*b* is shown in FIGS. 3, 5, 5B and 6. As will be readily appreciated the discussion which follows applies to all dispensers 31. For each dispenser 31 an angle bracket 137 is attached to mounting bracket 131 by rivets or screws 141 and 143. Also for each dispenser 31 a cover piece 145 is attached to the mounting bracket 131. The bracket 137 has a circular opening 151 through which a rotating member 153 of a gear assembly 155 protrudes. The gear assembly 155 is secured to the bracket 137 by screws (not shown) and is driven by a motor 161 with control and powering wires (not shown) passing through an opening 162 in bracket 131 (as shown in FIG. 6). These wires connect to the machine controller as shown in FIG. 1 of U.S. Pat. No. 4,512,453. The rotating member 153 has a square drive 163 which is attached to an offset lever 165. A pivoting arm 167 is pivotally attached at end 171 and at an opposite end 173**.

Mounting bracket 131 includes for each dispenser 31 hinge supports 181 and 182 which support pivot pins 183 therebetween. Each dispenser 31 has a levered gate 185 which is pivotally attached to one of the pins 183. The levered gate 185 has a clear ejector flap portion 187 attached by rivets 186 to an angle 188. The levered gate 185 also includes a retainer portion 189 which is continuous with the angle 188 and perpendicular to the flap portion 187. The retainer portion 189 includes a lip 191 and pieshaped segments 193 and 194 at either end. The pivoting arm 167 is pivotally attached to the levered gate 185 at the end 173.

Each of the four dispensers 31 has sides 201 and 203 having openings 205, 207 and 209 to permit air circulation. Additionally, each dispenser 31 has a top 202 and a bottom 204 mounted inside respectively the top panel 65 and bottom panel 67. A piece of insulating material 102 is placed between the bottom panel 67 and bottom 204. Attached to each of sides 201 and 203 is a rearward sloping support and guide 211 which extends from near the door 37 to an intermediate location near the rear panel 63 (FIGS. 3, 4, 5 and 6). Guide 211 supports a first level of drink containers and permits the containers to travel toward the rear of housing 48. A guide and duct 213 is secured to the sides 201 and 203 and to the bottom panel 67 near the rear panel 63. A frontward sloping support and guide 215 is attached to each of sides 201 and 203 and extends from the intermediate location near the rear panel 63 to near the door 27. Guide 215 supports a second level of drink containers and permits the containers to travel toward the front of housing 48.

Figure 3A:
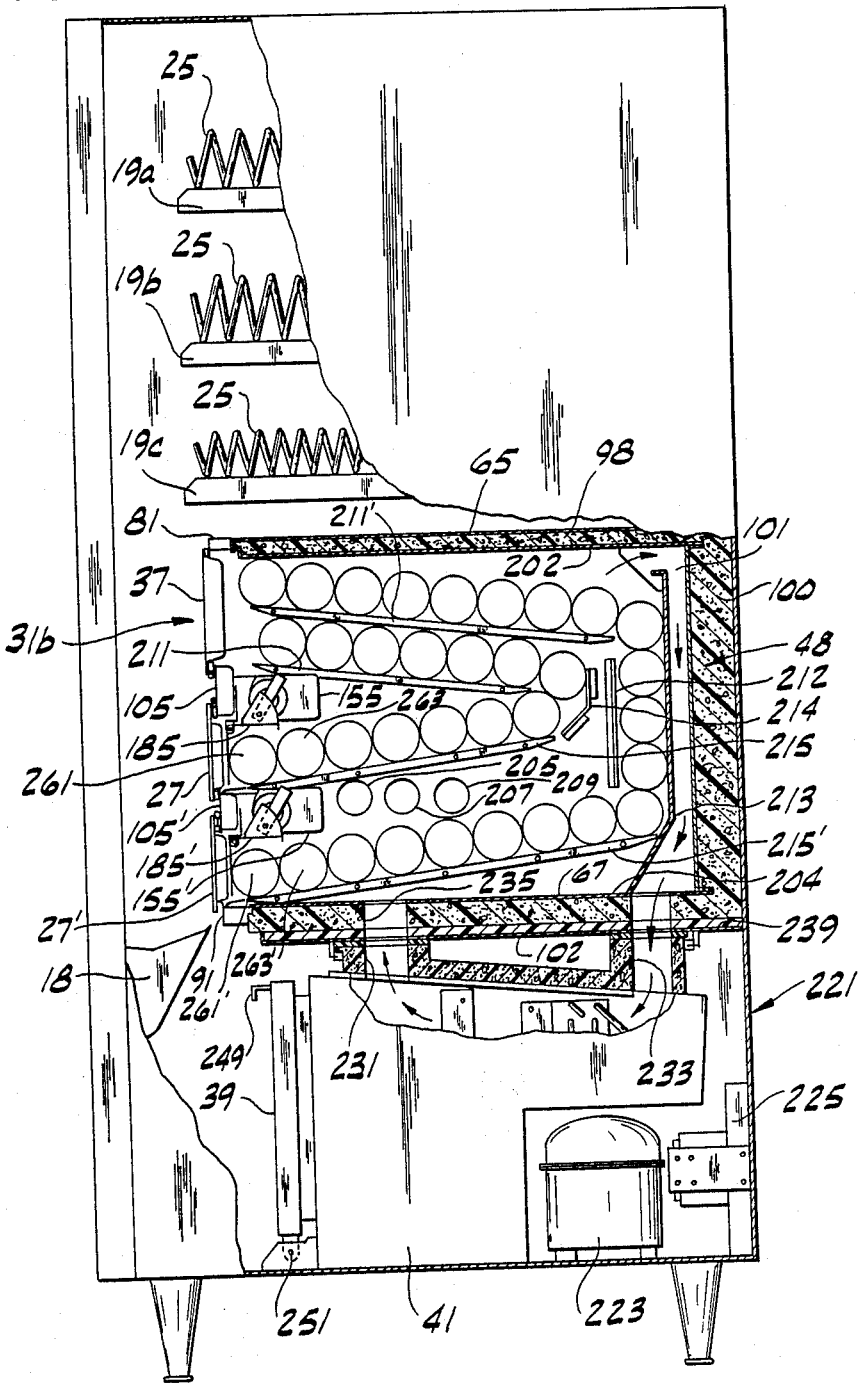
FIG. 3A is a side view of the vending machine with a portion cutaway showing an interior cross-section which includes an alternative preferred embodiment of the refrigerated area.
Figure 4A:
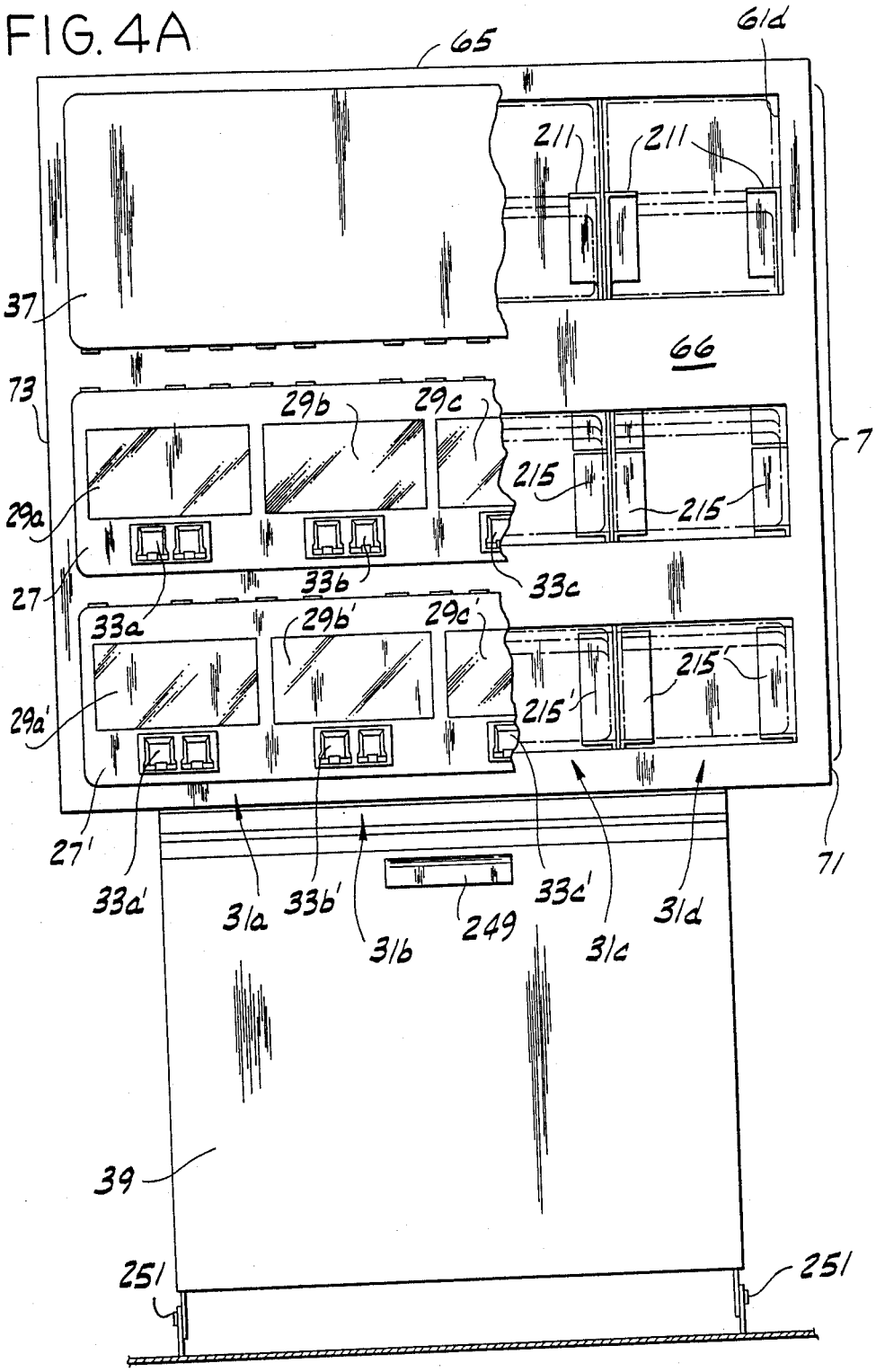
FIG. 4A is a close up view of the alternative preferred embodiment of the refrigerated area of the vending machine in FIG. 3A with a portion cutaway.

In FIGS. 3A, 4A and 5A is shown an alternative preferred embodiment of the refrigerated storage and dispensing area 7. For convenience corresponding parts are numbered identically as those parts shown in FIGS. 3, 4 and 5. The alternative preferred emobodiment includes additional parts which are labelled with primes (e.g., 215') and which are analogous to the parts without the primes. The clear continuous door exit 27 is masked so that four windows **29*a*, 29*b*, 29*c* and 29*d* are outlined for displaying the drink can to be next dispensed from one of four corresponding dispensers 31*a*, 31*b*, 31*c* and 31*d*. Another clear continuous exit door 27' is masked so that four windows 29*a'*, 29*b'*, 29*c'* and 29*d'* are outlined for displaying the drink can which may next be dispensed from one of four corresponding dispensers 31*a*, 31*b*, 31*c* and 31*d*. For illustration purposes the dispenser 31*b* is shown in FIG. 3A**.

In the alternative embodiment shown in FIGS. 3A, 4A and 5A, the door 37 provides access to a corresponding opening 61 in the housing 48 behind the door 37. As shown in FIG. 5A, dispenser **31*b* has an opening 61*b* for the insertion of the drink cans into the dispenser 31*b*. The drink cans may be inserted onto either guides 211 or rearward sloping guides 211'. Guides 211' extend from near door 37 to a first intermediate location near the rear panel 63. Guides 211 are below and substantially parallel to guides 211' and extend from near door 37 to a second intermediate location which is closer to door 37 than the first intermediate location. Thus, guides 211 and 211' support corresponding levels of drink containers and guide the drink containers to corresponding intermediate locations. At the first intermediate location the drink cans are vertical between guide and duct 213 and a guide bar 212. At the second intermediate location the drink cans travel vertically between one end of the guides 211 and deflector guides 214. The deflector guides 214 have a vertical portion and a portion sloped so that the drink cans are guided to downwardly sloping guides 215 which guide and support the drink cans toward the door 27. Similarly, the drink cans at the first intermediate location travel downward between guide and duct 213** and guide bars 212 to downwardly sloping guides 215' which guide and support the drink cans toward the door 27'. Thus, guides 215 and 215' support corresponding levels of drink containers and guide the drink containers toward the front of housing 48. The housing 48 thus is an example of housing means for enclosing a storage and dispensing area, the housing means having an access door 37 for inserting the containers and having first 27 and second 27' exit doors for dispensing the containers.

Additionally, guide 211' is an example of first guide means in the housing means 48 for guiding and supporting a first level of containers away from the access door 37 toward a first intermediate location near the rear of the housing means 48. And guide 215' is an example of second guide means in the housing means 48 for receiving containers from the first guide means at the first intermediate location, for guiding and supporting a second level of containers away from the intermediate location to the first exit door 27'.

Further, guide 211 is an example of third guide means in the housing means 48 for guiding and supporting a third level of containers away from the access door 37 toward a second intermediate location near the rear of the housing means 48, the third level of containers being positioned below the first level and the second intermediate location being closer the access door 37 than the first intermediate location. Also guide 215 is an example of fourth guide means in the housing means 48 for receiving containers from the third guide means at the second intermediate location and for guiding and supporting a fourth level of containers away from the intermediate location to the second exit door 27, the fourth level of containers being positioned above the second level.

Guide bars 212 and guide duct 213 are thus an example of fifth guide means at the first intermediate location for vertically guiding the containers from the first guide means to the second guide means. And guide 214 constitutes an example of sixth guide means at the second intermediate location for vertically guiding the containers from the third guide means to the fourth guide means.

The strip hinge 115 is attached to the center cross member 105 and door 27 to permit the door to swing outward. Similarly the strip hinge 115' is attached to center cross member 105' and door 27' to permit the door to swing outward. Angle bracket 137 is attached to mounting bracket 131 and similarly angle bracket 137' is attached to mounting bracket 131'. Bracket 137 and 137' have circular openings 151 and 151' and gear assemblies 155 and 155'. The gear assemblies 155 and 155' are driven by corresponding motors 161 and 161' and operate identically to the corresonding parts described above. Each dispenser 31 has levered gates 185 and 185' which is pivotally attached to one of pins 183 and 183', respectively.

Levered gates 185 and 185', gear assemblies 155 and 155', motors 161 and 161' and the parts which interconnect their operation thus constitute an example of first and second means respectively associated with the second and fourth container levels for selectably dispensing one of the containers from either the second or fourth levels, each dispensing means including: a levered gate (185 or 185') movable between an open and a closed position, the levered gate when in the closed position for retaining the container in the storage and dispensing area and when in the open position for dispensing one of the containers through the exit door (27 or 27') and for retaining the remaining containers in the storage and dispensing area, and means for moving the levered gate from the closed position to the open position to dispense one of the containers and to return the gate to the closed position.

Figure 7:
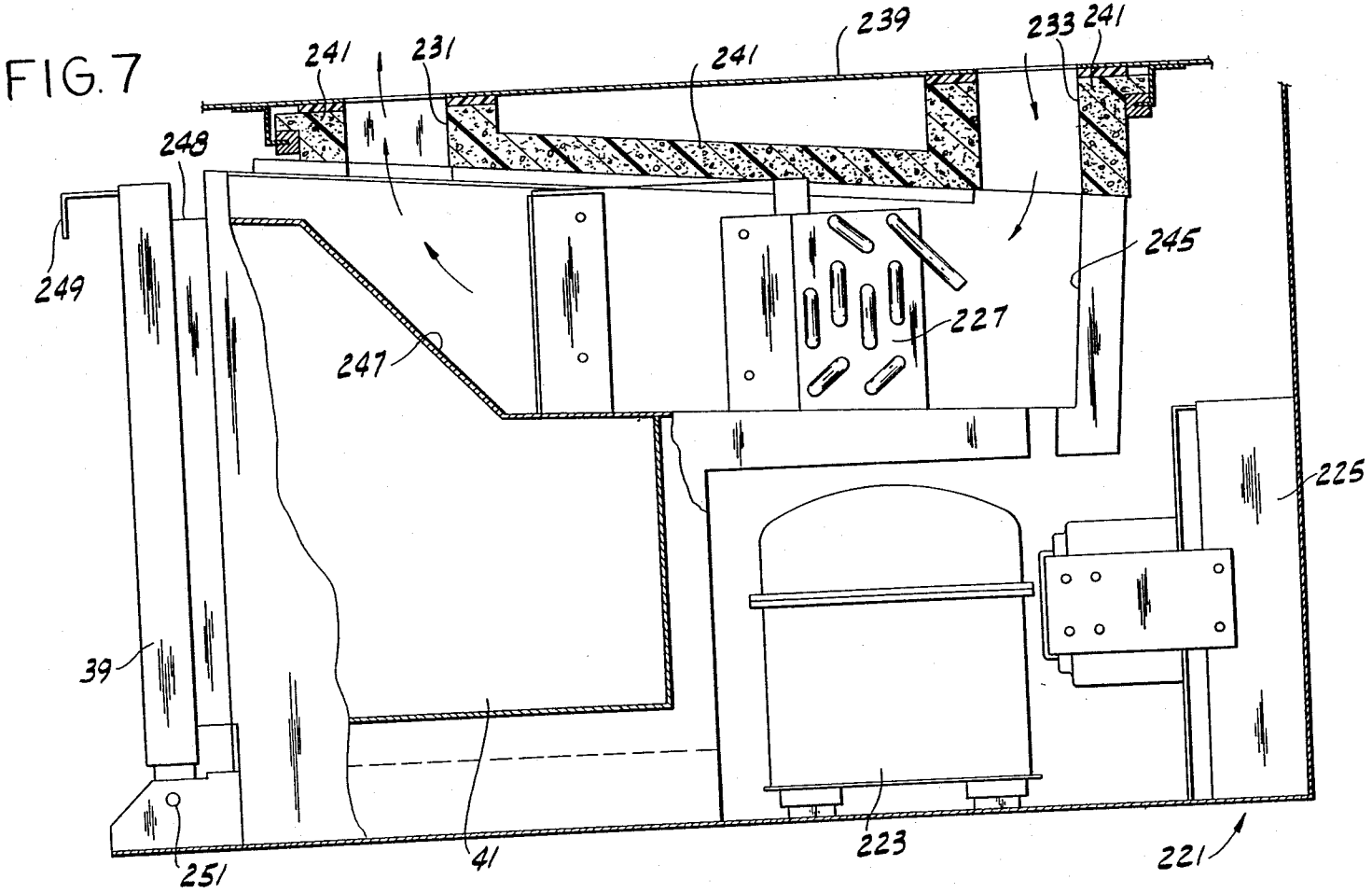
FIG. 7 is a close-up view of a refrigeration unit included in FIG. 3.

As may best be seen in FIGS. 3 and 7 a self-contained refrigeration unit and housing 221 is mounted adjacent the housing 48 for the refrigerated food storage and dispensing area 7. The refrigeration unit 221 includes a compressor 223 and condensor coils 225. Cooling or evaporator coils 227 of the refrigeration unit 221 are in an insulated area. There are two openings 231 and 233 formed in a single foam plastic member 241 and matching holes through a top portion 239 of the refrigerator unit and housing 221. These two openings 231 and 233 in the refrigeration unit 221 match openings 235 and 237 in the bottom panel 67 and the piece of insulating material 102. The foam plastic member 241 is thus used to form passageways between the housing 221 and the housing 48. Additional passageways 245 and 247 are found on either side of the cooling coils 227. A motor driven fan (not shown) forces air over the cooling coils 227 and out the opening 231 into the refrigerated storage and dispensing area 7. The air supplied to the refrigerated storage and dispensing area 7 is sufficient to cool the temperature to around 34° F. Cool air also passes into refrigerated area 41 through an opening (not shown) in passageway 247. Air is supplied to the fan from a top area 101 of the refrigerated area 7, between the duct 213 and the rear panel 63 and into the openings 237 and 233. The cooling air thus circulates through the refrigerated area 7 by passing through passageway 247, out the opening 231, into the housing 48, returned from area 101, back through opening 233 and into passageway 245. The refrigerator unit 221 thus constitutes means contained in the housing 15 for cooling the refrigerated foods in the refrigerated storage and dispensing area. In this way housing 48 includes housing means for enclosing only the refrigerated storage and dispensing area to contain the cooling. The opening 231 is thus an example of duct means for directing cooling air into the housing 48 through the opening 235.

Figure 8:
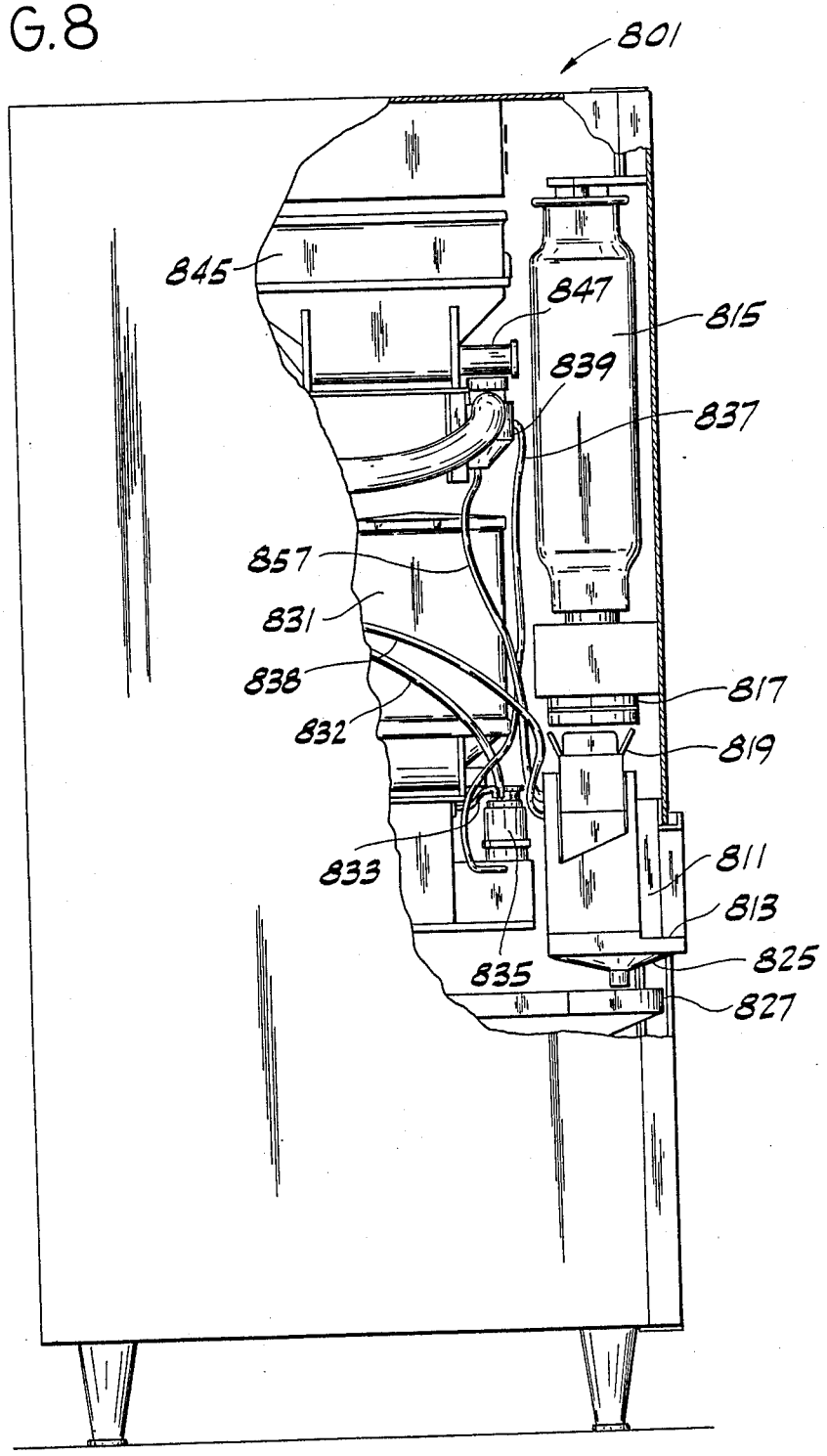
FIG. 8 is a side view of the vending machine in FIG. 1 partially cut away to show a heated area included in the vending machine.

As may best be seen in FIGS. 2 and 8 the heated storage and dispensing area 805 includes a cup turret assembly 815 for storing cups to be dispensed by a cup dispenser 817. Dispenser 817 is, for example, the dispenser described by U.S. Pat. No. 4,426,017 entitled "Apparatus for Dispensing Containers from a Stack of Nested Containers". The dispenser is aligned so that when a cup is dispensed, it is placed in the separate receiving device 811 and is thus accessible through an opening 813 in the door 3. The device 811 includes cup guide 819 and cup deflectors 821 and 823 which keep the cup in an upright position. A drain pan 825 empties into a collector 827 which empties into a pail 829.

Also included in the heated food area 805 is a hot water and coffee brewing system. The system includes a coffee canister 831 for storing and dispensing coffee. An electrically powered water heater (not shown) supplies hot water through a supply line 833 to a brewer 835. If coffee has been selected for dispensing by operation of the corresponding one of the switches 11 on the selection panel 9, coffee will be dispensed from the coffee canister 831 into the brewer 835 and the hot water will be forced by an air pressure pump (not shown) through the dispensed coffee. The brewed coffee will be pumped out of brewer 835 through an outlet line 837. If hot water was selected for dispensing by pressing an appropriate one of the switches 11, hot water will be pumped out of the water heater through an outlet line 838.

Line 837 supplies the brewed coffee to a mixing bowl 839. The mixing bowl 839 is supplied with sugar from a sugar storage canister 841 by a sugar dispenser 843 and is supplied with lightener from a lightener storage canister 845 by a lightener dispenser 847. When requested by the appropriate switches on the panel 9, sugar and/or lightener will be dispensed for mixing with the coffee. The coffee will exit bowl 839 through an outlet line 857 which connects to a dispensing outlet (not shown) in the separate receiving device 811. The hot water will travel through line 838 to the dispensing outlet.

The heated food area 805 thus constitutes an example of means contained in the housing means for heating the heated foods in the heated storage and dispensing area.

The operation and use of the vending machine 1 will now be described. With the door 3 open as shown in FIG. 2 the unrefrigerated foods may be placed between the spiral arms 25 in the unrefrigerated food storage and dispensing area 5. Because the door 3 is clear, different types of these foods may be mixed on each spriral arm. The refrigerated food may be conveniently stored in the refrigerated storage 41 for cooling prior to insertion in the dispensers 31. For example, previously stored drink cans or containers may be accessed through the door 39. The door 39 seals the refrigerated storage area 41 with a gasket 248 and opens by pulling downward on handle 249 thus pivoting the door 39 at hinge 251. These precooled cans may then be conveniently inserted from the front into the dispensers 31 by opening the door 37. Cans are placed in the openings 61 and will move down on the guides 21 and 215. In the alternative preferred emobodiment shown in FIGS. 3A, 4A and 5A cans or containers will also move down guides 211' and 215'. The can nearest the flap portion 187 of levered gate 185, i.e., can 261, will then be visible through the windows 29 and the clear flap portion 187. Because the can 261 is easily visible, different types of cans may be mixed in one of the dispensers 31. Additionally, in the alternative preferred embodiment the can 261' is visible through the windows 29'.

With the door 3 open, as may best be seen in FIGS. 2 and 8, cups are loaded in the cup turret assembly 815 for dispensing by the cup dispenser 817 into the separate receiving device 811. Coffee grounds are loaded into the coffee canister 831, sugar into the sugar storage canister 841 and lightener into a lightener storage canister 845. The door 3 may then be closed and the vending machine 1 is ready for dispensing. With the door 3 closed cool air escaping from the refrigerated storage and dispensing area 7 will reduce the temperature in the adjacent unrefrigerated storage and dispensing area 5.

Money is inserted into the selection panel 9 and when the proper amount is inserted, the push-button switches 11 on the panel 9 will permit dispensing. The user may conveniently select the food for dispensing since both the unrefrigerated foods in the unrefrigerated food storage and dispensing area 5 and the refrigerated foods in the refrigerated food storage and dispensing area 7 are visible through door 3. The user may also select the hot food for dispensing using the selection panel 9. The refrigerated food, e.g., the can nearest the flap portion 187, i.e., can 261, may be identified through window 29 and clear flap portion 187. As previously discussed the vendor control and selection system described in U.S. Pat. No. 4,512,453 is used for controlling dispenser motors for both the refrigerated and unrefrigerated foods. The selection panel 9 thus constitutes means for selecting one of the refrigerated foods, unrefrigerated foods or heated foods to be dispensed. The selection panel 9 also constitutes common means for selecting one of the refrigerated foods or heated foods to be dispensed to the receiving device 18 or device 811, respectively.

If an unrefrigerated food is selected for dispensing the motor connected to one of the spiral arms 25 will respond by rotating thus forcing the food to be pushed off the shelf 19. The unrefrigerated food package will then fall into the common receiving device or shelf 18 for retreival by the user.

If a refrigerated food, e.g., a drink can, is selected for dispensing, one of the motors 161 associated with the selected dispenser will begin rotating. The dispenser 31 starts in a closed position as shown in FIG. 5. This rotation (in the clockwise direction as shown in FIGS. 5 and 5A) causes the rotating member 153 of the gear assembly 155 to turn the offset lever 165. The pivoting arm 167 will pivot at the end 171 and at the opposite end 173. The levered gate 185 will then pivot on the pin 183. The flap portion 187 will push against the inside 109 of door 27 causing the door 27 to open. The lip 191 of retaining portion 189 will proceed into a position between the can nearest the flap portion 187, i.e., can 261, and the can next nearest the flap portion 187, i.e., can 263. The pieshaped segments 193 and 194 at either end of the levered gate 185 will then retain the can 263 in the dispenser 31. The rotation will continue and an open position will be reached as shown in FIG. 5B. The levered gate is thus movable between the closed position (FIG. 5) and the open position (FIG. 5B). In the open position the flap portion 187 has pushed the door 27 open so that the can 261 will then fall into the common receiving device 18 for retrieval by the user. The alternative embodiment shown in FIGS. 3A, 4A and 5A operates analogously for dispensing can 261 or 261'.

The common receiving device 18 thus constitutes common receiving means adjacent the refrigerated and unrefrigerated storage and dispensing areas for receiving dispensed foods from either the refrigerated or unrefrigerated storage and dispensing area. And the dispensers 31 and the spiral arms 25 are an example of means responsive to the selecting means for dispensing the selected food to the common receiving means.

The rotating member 153 will continue rotating through an entire revolution. Thus, after the open position in FIG. 5B is reached the levered gate 185 will move toward its closed position as shown in FIG. 5. As this rotation progresses the can 263 will eventually move to the position nearest the flap portion 187 when the lip 191 has risen to allow the can to clear it. The levered gate 185 returns to its closed position and all the cans remaining in the dispenser 31 will then move down the guides 211 and 215. Because the guides 211 and 215 extend from front to back, the number of cans that may be stored is increased.

If coffee or hot water is selected by pressing the appropriate one of the switches 11 on the selection panel 9, a cup will be dispensed from the cup dispenser 817 into the separate receiving device 811. If coffee was selected, coffee grounds will be dispensed from the coffee canister 831 into brewer 835 and brewed coffee will be pumped out of brewer 835 through an outlet line 837. If desired, sugar and/or lightener will be dispensed into the bowl 839 for mixing with the coffee. The outlet line 857 will carry the coffee to the dispensing outlet (not shown) in the separate receiving device 811. If hot water was selected, hot water will be pumped into the outlet line 838. The coffee or hot water will thus be dispensed into the cup which is retrieved in the device 811. The vending machine 1 is ready for dispensing another refrigerated, unrefrigerated or heated food. The device 811 is an example of receiving means for receiving the heated food from the heated storage and dispensing area.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A vending machine for dispensing refrigerated and heated foods comprising:

housing means having refrigerated storage and dispensing area for the refrigerated foods and a heatable food storage and dispensing area for the heated foods;

means contained in the housing means for cooling the refrigerated foods in the refrigerated storage and dispensing area;

means contained in the housing means for heating the heated foods in the heatable food storage and dispensing area;

means contained in the housing means for separating the heatable food storage and dispensing area from the refrigerated storage and dispensing area such that the heatable food storage and dispensing area is substantially unrefrigerated;

first receiving means adjacent the refrigerated storage and dispensing area for receiving dispensed foods from the refrigerated storage and dispensing area;

second receiving means for receiving the heated food from the heatable food storage and dispensing area;

common means for selecting one of the refrigerated foods or heated foods to be dispensed to the first or second receiving means, respectively; and means responsive to t he selecting means for dispensing the selected food to the first or second receiving means.

2. A vending machine as set forth in claim 1 wherein the heating means includes a heating unit for heating a liquid prior to dispensing, and wherein a cup dispenser is located within the heatable food storage and dispensing area having dispensing mechanism for depositing cups into the second receiving means, the second receiving means being adapted to receive both the liquid and the cups.

3. A vending machine as set forth in claim 2 wherein the heating means includes a coffee brewer adapted to hold coffee grounds for passing the heated liquid therethrough prior to dispensing.

4. A vending machine as set forth in claim 3 further comprising a lightener and sugar dispenser for measuring and dispensing lightener and/or sugar to a mixing chamber, the mixing adapted to receive coffee from the coffee brewer for mixing the coffee with lightner and/or sugar and a connecting pipe for carrying the mixed coffee to the second receiving means.

5. A vending machine as set forth in claim 1 further comprising another housing means for enclosing only the refrigerated storage and dispensing area to contain the cooling and wherein the other housing means has a door mounted thereto and a temporary storage area accessible through the door for reducing the temperature of refrigerated foods such that the refrigerated foods may be placed in the temporary storage area prior to placement in the refrigerated storage and dispensing area.

6. A vending machine as set forth in claim 1 further comprising another housing means for enclosing the refrigerated storage and dispensing area to contain the cooling, the other housing means having an opening for inserting the refrigerated foods into the refrigerated storage and dispensing area and having a door covering the opening, and spring means tending to keep the door closed.

7. A vending machine as set forth in claim 6 wherein the other housing means has a window therein for viewing the one of the refrigerated foods to be dispensed to the first receiving means.

8. A vending machine as set forth in claim 7 wherein the other housing means has another opening below the first named opening, the other opening for dispensing the refrigerated foods from the refrigerated storage and dispensing area and having another door covering the other opening.

9. A vending machine as set forth in claim 11 further comprising another housing means for enclosing only the refrigerated storage and dispensing area to contain the cooling, the other housing means having openings, and duct means for directing cooling air into the other housing means through the openings.

10. A vending machine as set forth in claim 9 wherein the duct means comprises a foam plastic member placed between the cooling means and the other housing means, the foam member defining ways which match the openings in the other housing means for circulating the cooling air.

11. A vending machine as set forth in claim 1 wherein the housing means has an opening and the first receiving means comprises a shelf attached to the housing means, the shelf being accessible from outside the housing means through the opening in the housing means.

12. A vending machine as set forth in claim 1 wherein the refrigerated storage and dispensing area of the housing means includes at least one levered gate movable between an open and a closed position which when in the open position permits one of the refrigerated foods to move to the first receiving means and retain the refrigerated foods remaining in the refrigerated food storage and dispensing area, and a motor which operates in response to the selecting means to move the at least one levered gate from the closed position to the open position to dispense one of the refrigerated foods and then returns the open gate to the closed position.

13. A vending machine as set forth in claim 1 wherein the first receiving means includes a shelf having a curved section immediately adjacent the refrigerated storage and dispensing area such that the refrigerated foods fall into the curved section.

14. A vending machine as set forth in claim 1 wherein the means for dispensing the selected food comprises a plurality of dispensers each for dispensing one of the refrigerated foods.

15. A vending machine for dispensing refrigerated, unrefrigerated and heated foods comprising:

housing means having a refrigerated storage and dispensing area for the refrigerated foods, and unrefrigerated storage and dispensing area for the unrefrigerated foods and a heatable food storage and dispensing area for the heated foods, each area being separate from the other areas;

means contained in the housing means for cooling the refrigerated foods in the refrigerated storage and dispensing area;

means contained in the housing means for heating the heated foods in the heatable food storage and dispensing area;

common receiving means adjacent the refrigerated and unrefrigerated storage and dispensing areas for receiving dispensed foods from either the refrigerated or unrefrigerated storage and dispensing area;

separate means for receiving the heated food from the heated storage and dispensing area;

common means for selecting one of the refrigerated foods, unrefrigerated foods or heated foods to be dispensed; and means responsive to the selecting means for dispensing the selected food to the common receiving means or separate receiving means.

16. A vending machine as set forth in claim 15 wherein the heating means includes a heating unit for heating a liquid prior to dispensing, and wherein a cup dispenser is located within the heatable food storage and dispensing area having a dispensing mechanism for depositing cups into the separate receiving means, the separate receiving means being adapted to receive both the liquid and the cups.

17. A vending machine as set forth in claim 16 wherein the heating means includes a coffee brewer adapted to hold coffee grounds for passing the heated liquid therethrough prior to dispensing.

18. A vending machine as set forth in claim 17 further comprising a lightener and sugar dispenser for measuring and dispensing lightener and/or sugar to a mixing chamber, the mixing the coffee with lightener and/or sugar and a connecting pipe for carrying the mixed coffee to the second receiving means.

19. A vending machine as set forth in claim 15 further comprising another housing means for enclosing only the refrigerated storage and dispensing area to contain the cooling and wherein the refrigerated storage and dispensing area and unrefrigerated storage and dispensing area are adjacent to reduce the temperature in the unrefrigerated storage and dispensing area by heat transfer between them.

20. A vending machine as set forth in claim 19 wherein the other housing means is positioned below the unrefrigerated storage and dispensing area and the cooling means supplies cool air through an opening in the other housing means to cool the refrigerated storage area.

21. A vending machine as set forth in claim 19 wherein the other housing means has a door mounted thereto and a temporary storage area accessible through the door for reducing the temperature of refrigerated foods such that the refrigerated foods may be placed in the temporary storage area prior to placement in the refrigerated storage and dispensing area.

22. A vending machine as set forth in claim 15 further comprising another housing means for enclosing the refrigerated storage and dispensing area to contain the cooling, the other housing means having an opening for inserting the refrigerated foods into the refrigerated storage and dispensing area and having a door covering the opening, and spring means tending to keep the door closed.

23. A vending machine as set forth in claim 22 wherein the other housing means has a window therein for viewing the one of the refrigerated foods to be dispensed to the common receiving means.

24. A vending machine as set forth in claim 22 wherein the other housing means has another opening below the first named opening, the other opening for dispensing the refrigerated foods from the refrigerated storage and dispensing area and having another door covering the other opening.

25. A vending machine as set forth in claim 15 wherein the means for dispensing the selected food comprises a plurality of dispensers each for dispensing one of the unrefrigerated foods and a plurality of dispensers each for dispensing one of the refrigerated foods.

26. A vending machine as set forth in claim 15 further comprising another housing, means for enclosing only the refrigerated storage and dispensing area to contain the cooling, the other housing means having openings, and duct means for directing cooling air into the other housing means through the openings.

27. A vending machine as set forth in claim 26 wherein the duct means comprises a foam plastic member placed between the cooling means and the other housing means, the foam member defining passageways which match the openings in the other housing means for circulating the cooling air.

28. A vending machine as set forth in claim 15 wherein the housing means has an opening and the common receiving means comprises a shelf attached to the housing means, the shelf being accessible from outside the housing means through the opening in the housing means.

29. A vending machine as set forth in claim 15 wherein the unrefrigerated storage and dispensing are of the housing means includes at least one spiral arm which separates the unrefrigerated foods in the storage and dispensing area and a motor which operates in response to the selecting means for rotating the at least one spiral arm to dispense one of the unrefrigerated foods.

30. A vending machine as set forth in claim 15 wherein the refrigerated storage and dispensing area of the housing means includes at least one levered gate movable between an open and a closed position retains the refrigerated foods in the refrigerated food storage and dispensing area and when in the open position permits one of the refrigerated food storage and dispensing area, and a motor which operates in response to the selecting means to move the at least one levered gate from the closed position to the open position to dispense one of the refrigerated foods and then returns the opened gate to the closed position.

31. A vending machine as set forth in claim 15 wherein common receiving means includes a shelf having a curved section immediately adjacent the refrigerated storage and dispensing area such that the refrigerated foods fall into the curved section.

32. A vending machine as set forth in claim 31 wherein the unrefrigerated storage and dispensing area includes a shelf for holding the unrefrigerated foods and spiral arms for separating the unrefrigerated foods and the dispensing means includes means for rotating the spiral arms such that one of the unrefrigerated foods is forced from the shelf to the common receiving means.

33. A vending machine for dispensing drink containers, food packages and hot liquids comprising:

housing means having a drink container storage and dispensing area, a food package storage and dispensing area and a liquid storage and dispensing area, each area being separate from the other areas;

means contained in the housing means for cooling the drink containers in the drink container storage and dispensing area;

means contained in the housing means for heating the liquid in the liquid storage and dispensing area;

common receiving means for receiving dispensed food packages and drink containers, the common receiving means adjacent the drink container and food package storage and dispensing areas;

separate means for receiving the hot liquid from the liquid storage and dispensing area;

means for selecting one of the drink containers, food packages or hot liquid to be dispensed into the common receiving means or separate receiving mean; and means responsive to the selecting means for dispensing the selected drink container or food package to the common receiving means and for dispensing the selected hot liquid to the separate receiving means.

34. A vending machine as set forth in claim 33 further comprising a cup dispenser having a dispensing mechanism for depositing cups into the separate receiving means, the separate receiving means being adapted to receive both the hot liquid and the cups.

35. A vending machine as set forth in claim 34 wherein the heating means includes a coffee brewer adapted to hold coffee grounds for passing the heated liquid therethrough prior to dispensing.

36. A vending machine as set forth in claim 35 further comprising a lightener and sugar dispenser for measuring and dispensing lightener and/or sugar to a mixing and/or sugar to a mixing chamber, the mixing chamber adapted to receive coffee from the coffee brewer for mixing the coffee with lightener and/or sugar and a connecting pipe for carrying the mixed coffee to the second receiving means

37. A vending machine as set forth in claim 33 wherein the common receiving means includes a shelf having a curved section immediately adjacent the refrigerated storage and dispensing area such that the refrigerated foods fall into the curved section.

38. A vending machine as set forth in claim 37 wherein the unrefrigerated storage and dispensing area includes a shell for holding the unrefrigerated foods and spiral arms for separating the unrefrigerated foods and the dispensing means includes means for rotating the spiral arms such that one of the unrefrigerated foods is forced from the shelf to the common receiving means.

39. A vending machine as set forth in claim 33 further comprising another housing means for enclosing only the drink container storage and dispensing area to contain the cooling and wherein the drink container storage and dispensing area and food package storage and dispensing area are adjacent to reduce the temperature in the food package storage and dispensing area by heat transfer between them.

40. A vending machine as set forth in claim 39 wherein the other housing means has a door mounted thereto and a temporary storage area accessible through the door for reducing the temperature of drink containers such that the drink containers may be placed in the temporary storage area prior to placement in the drink container storage and dispensing area.

41. A vending machine as set forth in claim 39 wherein the other housing means is positioned below the food package storage and dispensing area and the cooling means supplies the cooling through an opening in the other housing means.

42. A vending machine as set forth in claim 33 further comprising another housing means for enclosing the drink container storage and dispensing area to contain the cooling, the other housing means having an opening for inserting the drink containers into the drink container storage and dispensing area and having a door covering the opening, and spring means tending to keep the door closed.

43. A vending machine as set forth in claim 42 wherein the other housing means has a window mounted thereon for viewing the one of the drink containers to be dispensed to the common receiving means.

44. A vending machine as set forth in claim 42 wherein the other housing means has another opening below the first named opening, the other opening for dispensing the drink containers from the drink container storage and dispensing area and having another door covering the other opening.

45. A vending machine as set forth in claim 33 wherein the means for dispensing the selected food comprises a plurality of dispensers each for dispensing one of the food packages and a plurality of dispensers each for dispensing one of the drink containers.

46. A vending machine as set forth in claim 33 further comprising another housing means for enclosing only the drink container storage and dispensing area to contain the cooling, the other housing means having openings, and duct means for directing cooling air into the other housing means through the openings.

47. A vending machine as set forth in claim 46 wherein the duct means comprises a foam plastic member placed between the cooling means and the other housing means, the foam member defining passageways which match the openings in the other housing means for circulating the cooling air.

48. A vending machine as set forth in claim 33 wherein the housing means has an opening and the common receiving means comprises a shelf attached to the housing means, the shelf being accessible from outside the housing means through the opening in the housing means.

49. A vending machine as set forth in claim 33 wherein the food package storage and dispensing area of the housing means includes at least one spiral arm which separates the food packages in the storage and dispensing area and a motor which operates in response to the selecting means for rotating the at least one spiral arm to dispense one of the food packages.

50. A vending machine as set forth in claim 33 wherein the drink container storage and dispensing area of the housing means includes at least one levered gate movable between an open position and a closed position which when in the closed position retains the drink containers in the drink container storage and dispensing area and a motor which operates in response to the selecting means to move the at least one levered gate from the closed position to the open position to dispense one of the drink containers and then returns the gate to the closed position.

51. A vending machine for dispensing drink containers, food packages and hot liquids comprising:

a housing having a refrigerated drink container storage and dispensing area, a food package storage and dispensing area and a liquid storage and dispensing area, each area being separate from the other areas;

a self-contained refrigeration unit for providing forced cool air circulation into the refrigerated drink container storage and dispensing area;

a common receiving device for receiving dispensed drink containers and food packages, the common receiving device adjacent both the drink container and food package storage and dispensing areas;

a separate receiving device for receiving dispensed heated liquid and cups;

a heating unit for heating the liquid prior to dispensing;

a cup dispenser having a dispensing mechanism for depositing the cups into the separate receiving device;

a selection panel having plurality of switches for selecting the food package, drink container or hot liquid to be dispensed;

a drink container dispenser in the refrigerated area having a dispensing mechanism responsive to the switches of the selection panel for depositing one of the containers into the common receiving device;

a food package dispenser having a dispensing mechanism responsive to the switches of the selection panel for depositing one of the food packages into the common receiving device; and a hot liquid dispenser having a dispensing mechanism responsive to the switches of the selection panel for dispensing the hot liquid into a cup deposited in the separate receiving device.

52. A vending machine as set forth in claim 51 wherein the heating means includes a coffee brewer adapted to hold coffee grounds for passing the heated liquid therethrough prior to dispensing.

53. A vending machine as set forth in claim 52 further comprising a mixing chamber adapted to receive coffee from the coffee brewer for mixing the coffee with lightener and/or sugar, and a lightener and sugar dispenser for measuring and dispensing lightener and/or sugar to the mixing chamber.

54. A vending machine as set forth in claim 51 wherein the common receiving device includes a shelf having a curved section immediately adjacent the refrigerated storage and dispensing area such that the refrigerated foods fall into the curved section.

55. A vending machine as set forth in claim 54 wherein the unrefrigerated storage and dispensing area includes a shelf for holding the unrefrigerated foods and spiral arms for separating the unrefrigerated foods and the dispensing means includes means for rotating the spiral arms such that one of the unrefrigerated foods is forced from the shelf to the common receiving device.

56. A vending machine as set forth in claim 51 further comprising another housing for enclosing only the drink container storage and dispensing area to contain the cooling and wherein the drink container storage and dispensing area and food package storage and dispensing area are adjacent to reduce the temperature in the food package storage and dispensing area by heat transfer between them.

57. A vending machine as set forth in claim 56 wherein the other housing has a door mounted thereto and has a temporary storage area accessible through the door for reducing the temperature of drink containers such that the drink containers may be placed in the temporary storage area prior to placement in the drink container storage and dispensing area.

58. A vending machine as set forth in claim 56 wherein the other housing is positioned below the food package storage and dispensing area and the refrigeration unit supplies the cool air through an opening in the other housing.

59. A vending machine as set forth in claim 51 further comprising another housing for enclosing the drink container storage and dispensing area to contain the cooling, the other housing having an opening for inserting the drink containers into the drink container storage and dispensing area and having a door covering the opening, and spring means tending to keep the door closed.

60. A vending machine as set forth in claim 59 wherein the other housing has a window therein for viewing the one of the drink containers to be dispensed to the common receiving means.

61. A vending machine as set forth in claim 59 wherein the other housing has another opening below the first named opening, the other opening for dispensing the drink containers from the drink container storage and dispensing area and having another door covering the other opening.

62. A vending machine as set forth in claim 51 further comprising another drink container dispenser in the refrigerated area having a dispensing mechanism responsive to the switches of the selection panel for depositing another one of the containers into the common receiving device and another food package dispenser having a dispensing mechanism responsive to the switches of the selection panel for depositing another one of the food packages into the common receiving device.

63. A vending machine as set forth in claim 51 further comprising another housing for enclosing only the drink container storage and dispensing area to contain the cooling, the other housing having openings, and ducts for circulating cooling air through the openings.

64. A vending machine as set forth in claim 63 wherein the ducts are formed of a foam plastic member placed between the refrigeration unit and the other housing, the foam member forming passageways which match the openings in the other housing for circulating the cooling air.

65. A vending machine as set forth in claim 51 wherein the housing has an opening and the common receiving device comprises a shelf attached to the housing, the shelf being accessible from outside the housing through the opening in the housing.

66. A vending machine as set forth in claim 51 wherein the food package dispenser comprises a spiral arm which separates the food packages in the storage and dispensing area and a motor which operates in response to one of the plurality of switches on the selection panel for rotating the spiral arm to dispense one of the food packages.

67. A vending machine as set forth in claim 51 wherein the drink container dispenser comprises a levered gate movable between an open position and a closed position which when in the closed position retains the drink containers in the drink container storage and dispensing area and when in the open position permits one of the drink containers to move to the common receiving device and retain the drink containers remaining in the drink container storage and dispensing area, and a motor which operates in response to one of the plurality of switches on the selection panel to move the levered gate from the closed position to the open position to dispense one of the drink containers and then returns to the closed position.

* * * * *

UNITED STATES PATENT AND TRADEMARK OFFICE

CERTIFICATE OF CORRECTION

PATENT NO. : 4,823,984

DATED : April 25, 1989

INVENTOR(S) : Leonard A. Ficken

It is certified that error appears in the above-identified patent and that said Letters Patent is hereby corrected as shown below:

Column 11, line 22, "having refrigerated", should read ---having a refrigerated---.

Column 11, line 47, "to t he selecting", should read ---to the selecting---.

Column 12, line 29, "claim 11, should read ---claim I---.

Column 12, line 38, "defining ways which", should read ---defining passageway which---.

Column 12, line 50, "the open position", should read ---the closed position retains the refrigerated foods in the refrigerated food storage and dispensing area and when in the open position---.

Column 13, line 40, "mixing the coffee", should read ---mixing chamber adapted to receive coffee from the coffee brewer for mixing the coffee---.

Column14, line 39, "dispensing are of ", should read ---dispensing area of---.

Column 14, line 49, "position retains", should read ---position which when in the closed position retains---.

UNITED STATES PATENT AND TRADEMARK OFFICE

CERTIFICATE OF CORRECTION

PATENT NO. : 4,823,984

DATED : April 25, 1989

INVENTOR(S) : Leonard A. Ficken

It is certified that error appears in the above-identified patent and that said Letters Patent is hereby corrected as shown below:

Column 14, line 52, "refrigerated food storage", should read --refrigerated foods to move to common receiving means and retain the refrigerated foods remaining in the refrigerated food storage--

Column 16, line 64, "and a motor", should read -- and when in the open position permits one of the drink containers to move to the common receiving means and retain the drink containers remaining in the drink container storage and dispensing area, and a motor--

Signed and Sealed this

Twenty-sixth Day of March, 1991

*Attest:*

HARRY F. MANBECK, JR.

*Attesting Officer*

*Commissioner of Patents and Trademarks*